United States Patent [19]

Groves

[11] 4,393,853

[45] Jul. 19, 1983

[54] EXHAUST GAS RECIRCULATION TYPE INTERNAL COMBUSTION ENGINES AND METHOD OF OPERATING SAME

[75] Inventor: William N. Groves, Rapid City, S. Dak.

[73] Assignee: Research Corporation, New York, N.Y.

[21] Appl. No.: 290,798

[22] Filed: Aug. 6, 1981

[51] Int. Cl.[3] ..... F02M 25/06

[52] U.S. Cl. ..... 123/568; 123/308; 123/433

[58] Field of Search ..... 123/568, 308, 315, 433, 123/432

[56] References Cited

U.S. PATENT DOCUMENTS 1,555,991 10/1925 Konar ..... 123/308

2,701,556 2/1955 Woerner ..... 123/568

FOREIGN PATENT DOCUMENTS 55-91719 7/1980 Japan ..... 123/433

*Primary Examiner*—Wendell E. Burns

*Attorney, Agent, or Firm*—Scully, Scott, Murphy and Presser

[57] ABSTRACT

A multi-cylinder internal combustion engine is disclosed in which a portion of the exhaust gas is selectively added to each cylinder. The exhaust gas is caused to swirl along the inside wall of the cylinder. Air or a fuel/air mixture is caused to swirl in a central zone in the cylinder in the same direction of swirl as the direction of swirl of the exhaust gas thereby providing a stratified exhaust gas recirculation design.

6 Claims, 10 Drawing Figures

STRATIFIED CHARGE:
a - MIXTURE FUEL + AIR
b - EGR

EXHAUST GAS RECIRCULATION TYPE INTERNAL COMBUSTION ENGINES AND METHOD OF OPERATING SAME

TECHNICAL FIELD

This invention is directed to a multiple cylinder internal combustion engine in which a portion of the exhaust gas is selectively added to each cylinder along with the fuel or fuel-air mixture to thereby materially reduce fuel consumption at all operating engine speeds.

BACKGROUND OF THE PRIOR ART

Present technology spark ignition engines have the problem of lower efficiency at part load. The loss of efficiency is caused by: loss due to throttling of the intake mixture; slow combustion due to lower density of the throttled mixture; excessive heat loss to the combustion chamber walls and energy wasted in disassociation reactions during combustion.

In addition to low efficiency at part load, present technology engines are troubled by exhaust gas emission problems. Emission of unburned hydrocarbons results from choking when cold starting and from flame quenching at the cylinder walls. Emission of nitrogen oxides results from excessive combustion temperatures.

It is known in the art to overcome some of these problems by exhaust gas recirculation (EGR) and a number of patents have issued which are directed to EGR systems and methods of operating internal combustion engines. Exemplary of such patents are:

Virk et al U.S. Pat. No. 4,265,721
Resler, Jr. U.S. Pat. No. 4,135,481
Hattori U.S. Pat. No. 4,119,071
Gagliardi U.S. Pat. No. 4,011,846
Might U.S. Pat. No. 4,060,061
Blaser U.S. Pat. No. 4,060,059
Villela U.S. Pat. No. 3,905,344
Dahlstrom U.S. Pat. No. 3,799,130
Saiki U.S. Pat. No. 4,194,475

While EGR systems are helpful in lowering pollution in internal combustion engines, Indicated Specific Fuel Consumption (ISFC) is also lowered when combustion rates are fast enough.

BRIEF SUMMARY OF THE INVENTION

The problems of the prior systems are overcome in the stratified EGR system of the present invention in the following ways:

(1) EGR admitted into the cylinder at the end of the intake stroke displaces some of the fuel/air mixture, forcing the mixture back through the intake valve and into the intake manifold. Thus part load is attained with minimum throttling of the intake fuel/air mixture. Load may be controlled by throttling the EGR, i.e. EGR throttle open reduces engine output. Conversely, EGR throttle closed shuts off the EGR and the cylinder produces maximum power. At maximum power there is little if any difference between the stratified EGR engine and present engines.

(2) Slow combustion is overcome in the Stratified EGR engine design by having a high density mixture (minimum intake throttling), by short flame path and by high turbulence. The stratification consists of swirling EGR around the cylinder wall and swirling the fuel/air mixture concentrated in the center of the cylinder near the spark plug. Since both the EGR and the fuel/air mixture are swirling at a high rate and in the same direction, a rapid flame propagation is produced. The flame path is shorter because the flame only has to progress from the spark plug to the outer radius of the central fuel/air zone.

(3) Excessive heat loss from the burning mixture to the cylinder wall is avoided because the swirling, hot EGR gases are adjacent to the wall and thus shield the central fuel/air mixture from the wall.

Since in the stratified EGR engine design hot exhaust gas surrounds the fuel/air mixture the system provides faster engine warm up (i.e., a quick opening choke may be used) and should eliminate flame quenching at the cylinder wall, since the flame does not propagate all the way to the wall.

The stratified EGR concept of the present invention is a modification to existing 4 stroke cycle engines, which will reduce part-load fuel consumption and reduce undesirable exhaust emissions. The modification is designed to introduce exhaust gas into the cylinder through at least one tangentially oriented port located just above the bottom dead center position of the piston. In order to attain high swirl velocity, exhaust gas at blowdown pressure from another cylinder or from an exhaust gas manifold is directed into the at least one port via a duct. This duct, in the first case connects the tangentially oriented ports of two cylinders which are 360 degrees apart on the firing order of a multi-cylinder engine. Incorporated in the duct may be a throttle valve for control of the amount of EGR and a heat exchanger to control the temperature of the EGR. Another element of the modification is a means to swirl the intake fuel-air mixture as it enters the cylinder through the intake valve. Summarizing, the stratified EGR design is comprised of:

(1) at least one tangential EGR port in each of the cylinders;

(2) a duct connecting the EGR ports of the cylinders with a source of exhaust gas; and (3) a means for providing swirl of the intake air or fuel-/air mixture;

Stratification is attained by having the EGR and the air or fuel/air mixture swirling at nearly the same rate of rotation, $\omega$. In this way the viscous shear at the EGR-/mixture interface is minimized, thus turbulent mixing at the interface is minimized. Since the EGR is introduced at the cylinder wall where centrifugal force, $r\,\omega^2$, is the greatest, the centrifugal force field will keep the EGR next to the internal wall of the cylinder during the compression stroke.

BRIEF DESCRIPTION OF THE DRAWINGS

The invention will be more particularly described in reference to the drawings wherein.

DETAILED DESCRIPTION OF THE INVENTION

Figure 1:
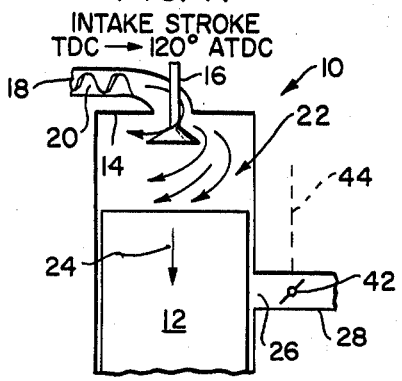
FIG. 1 diagrammatically illustrates number 1 cylinder of an Otto cycle four cylinder engine having the firing order 1-4-3-2 with the number 1 cylinder intake EGR port uncovering at 120° ATDC.

The features of the present invention will be most clearly understood in references to FIGS. 1 through 7 and 9 illustrating a single cylinder 10 of a multi-cylinder Otto cycle type internal combustion engine. The cylinder 10 selected for illustration is cylinder No. 1 of a four cylinder engine having a firing order 1-4-3-2. The cylinder 10 has reciprocally mounted therein a piston 12. At the head end 14 of the cylinder 10 is centrally located inlet valve 16 having usual valve opening and closing mechanism now shown. A fuel/air mixture from a conventional carburetor is directed into the cylinder via an intake manifold 18 which intake manifold is provided with a gas swirling vane member diagrammatically illustrated at 20. The swirling vane 20 is so configured as to cause the fuel/air mixture entering the cylinder when the valve 16 is opened to swirl in the direction of the directional arrows 22.

In the engine being described FIG. 1 illustrates a portion of the intake stroke with the piston 12 moving in the direction of the piston movement arrow 24. The intake stroke commences at top dead center and the valve 16 remains open to about 60° after top dead center.

Figure 2:
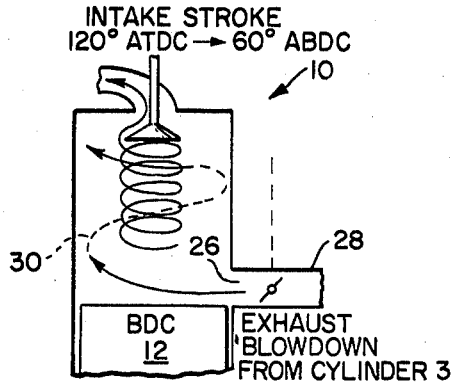
FIG. 2 is a diagrammic illustration of the same cylinder at the end of the intake stroke.
Figure 9:
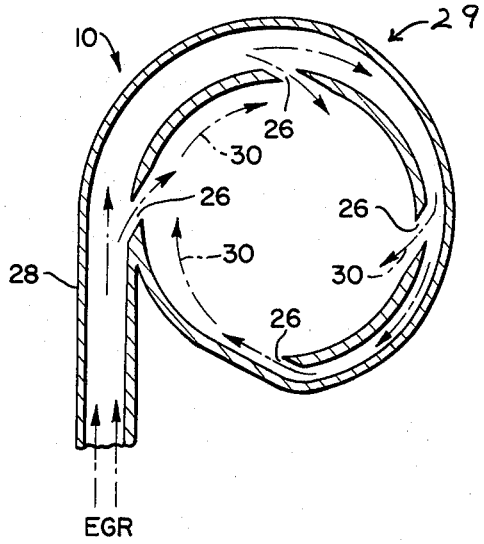
FIG. 9 is a diagrammatic view of the tangential inlet port suitable for directing exhaust gas in a swirling path into an engine cylinder.

In FIG. 2 the piston 12 is illustrated at the bottom dead center position and EGR ports 26 are illustrated as being uncovered by the piston from the piston position of 120° after top dead center to a piston position of 60° after bottom dead center. The EGR ports 26, as more clearly illustrated in FIG. 9, are tangential in nature and connected to an exhaust gas conduit 28 via a scroll-like header 29. The gas conduit 28 in the present invention is connected to an equivalent header and ports of number 3 cylinder to provide a pressurized supply of exhaust gas for the number 1 cylinder.

While in FIG. 9 plural tangential inlets are illustrated, it is considered that a single tangential inlet would prove adequate for engines having small diameter cylinders.

It will be noted from the exhaust gas flow arrows 30, in FIGS. 2 and 9, that the tangential inlets 26 are so positioned relative to the cylinder 10 that the direction of swirl of the exhaust gases is in the same direction of swirl as the fuel/air mixture entering the cylinder via the valve 16. This reduces viscous shear at the exhaust gas/fuel air mixture interface and this reduction in viscous shear minimizes turbulent mixing at the interface thus maximizing stratification of the exhaust gas swirling about the internal surface of the cylinder 10 and the fuel/air mixture rotating inwardly thereof.

Figure 3:
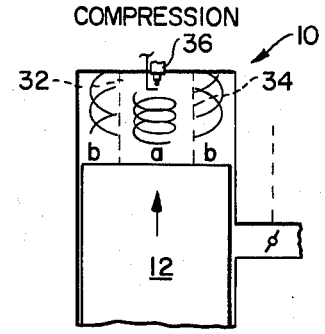
FIG. 3 illustrates the same cylinder during compression.
Figure 4:
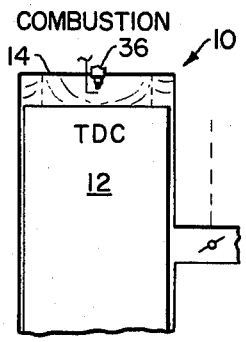
FIG. 4 illustrates the same cylinder during combustion.

In FIG. 3 illustrating the compression stroke for cylinder 10, dotted lines 32 and 34 illustrate the cylindrical boundary between the fuel/air mixture designated a and the exhaust gases designated b. Smoke chamber studies have established that there is substantially little commingling of the exhaust gas with a fuel/air mixture during compression of the gases in the cylinder. At top dead center, FIG. 4, ignition takes place via the spark plug 36 conventionally, electrically connected to a source of voltage and ignition timing means not illustrated. The spark plug is positioned in the head 14 of the cylinder 10 such that the spark gap thereof will be positioned in the fuel/air mixture zone.

From the foregoing description of the cycle it will be observed that under throttling conditions the compression pressure remains high as the exhaust gases entering the cylinder via the tangential ports 26 insures that a full volume of gases is induced in the cylinder notwithstanding throttling of the engine fuel/air mixture. It will also be observed that since the swirling fuel/air mixture and exhaust gases maintain stratification in the cylinder an optimum combustible mixture is always present adjacent the spark plug at the time of ignition thereby minimizing incomplete combustion and the discharge of partially combusted products.

Figure 5:
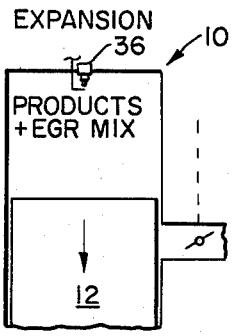
FIG. 5 illustrates the expansion or power stroke of the same cylinder.
Figure 6:
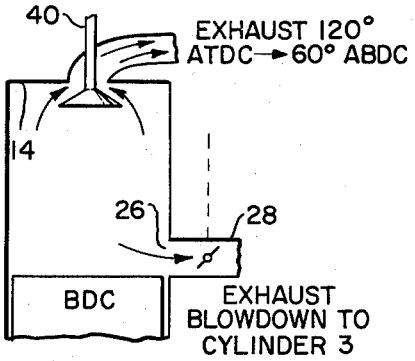
FIG. 6 illustrates the beginning of the exhaust stroke.
Figure 7:
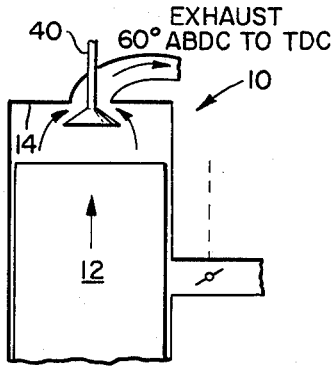
FIG. 7 illustrates the same cylinder approaching the end of the exhaust stroke.

FIG. 5 illustrates the power stroke of cylinder 10 whereas FIG. 6 illustrates that on the power stroke of the piston 12 the EGR tangential ports 26 commence to open at 120° after top dead center and remain open to 60° after bottom dead center. The exhaust valve illustrated at 40 opens to permit certain of the products of combustion to conventionally exhaust from the cylinder while another portion exhausts via the tangential EGR ports 26 and conduit 28 to provide pressurized exhaust for cylinder 3 of the four cylinder engine of the example. Between 60° after bottom dead center and top dead center the remaining products of combustion within the cylinder are exhausted via the exhaust valve 40 (FIG. 7).

It will be noted in FIGS. 1 through 7 that a throttle valve 42 is illustrated as being mounted in the conduit 28 and connected by mechanical linkage 44 to, for example, the carburetor throttle valve, such that when the carburetor throttle valve is open the exhaust gas conduit throttle valve 42 is closed and vice versa. With such an arrangement during full load operation of the engine substantially no exhaust gases are recirculated into the cylinder whereas during part load operation with the intake throttle partially closed, exhaust valve throttle 42 would be fully opened to permit maximum intake of exhaust gases into the cylinder.

While this arrangement of exhaust gas throttle and linkage means is illustrated in FIGS. 1 through 7, it has been found that satisfactory operation of the engine will also be had without the throttle valve in the exhaust gas conduit. When the exhaust gas conduit is unthrottled, the engine power may be regulated with conventional throttle control of the inlet air flow and the percent exhaust gas recirculated will be approximately constant. It has been observed that an engine operating with an unthrottled stratified exhaust gas recirculation system of the present invention exhibits a reduction in ISFC while experiencing only a small (about 15%) drop in IHP. Thus it would appear advantageous, from the efficiency standpoint, to operate the engine at high %EGR and accept a lower maximum power output.

Figure 8:
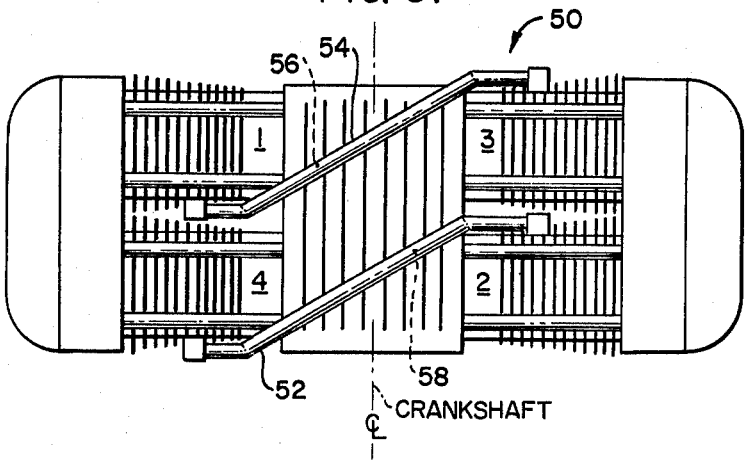
FIG. 8 is a somewhat diagrammatic view of a four cylinder Volkswagen engine modified to illustrate a suitable duct arrangement for the cylinders.

Referring now to FIG. 8 there is illustrated a four cylinder Volkswagen Otto Cycle internal combustion engine modified to include the concepts of the present invention wherein the engine 50 is provided with a pair of conduits 52 and 54. Conduit 54 connects the EGR ports of the first and third cylinders to provide the exhaust flow for operating the stratified engine whereas conduit 52 connects the EGR tangential inlet ports of cylinders 4 and 2. Other than providing the tangential inlets and the connecting exhaust conduits 52 and 54, modification of a conventional Volkswagen engine requires placement of gas swirling means in the fuel/air inlet ducts to the four cylinders and carburetor readjustment.

Further it was found that in order to prevent oil from the engine crank case from entering the EGR ports the ports should be positioned above the highest position of the piston oil rings, and seals were fitted to the piston pin of each piston. With these modifications, in order to provide a modified engine having the same compression ratio as the unmodified Volkswagen engine, each cylinder head contour was changed by milling out the squish space and each piston head was crowned. The milling and crowning steps provided a stratified EGR engine with the same compression ratio as the original Volkswagen engine.

In FIG. 8 there is also illustrated by broken lines the mechanical linkages 56 and 58 which are connected to the fuel/air throttle valve linkage for use when throttling of the exhaust gases is desired.

Figure 10:
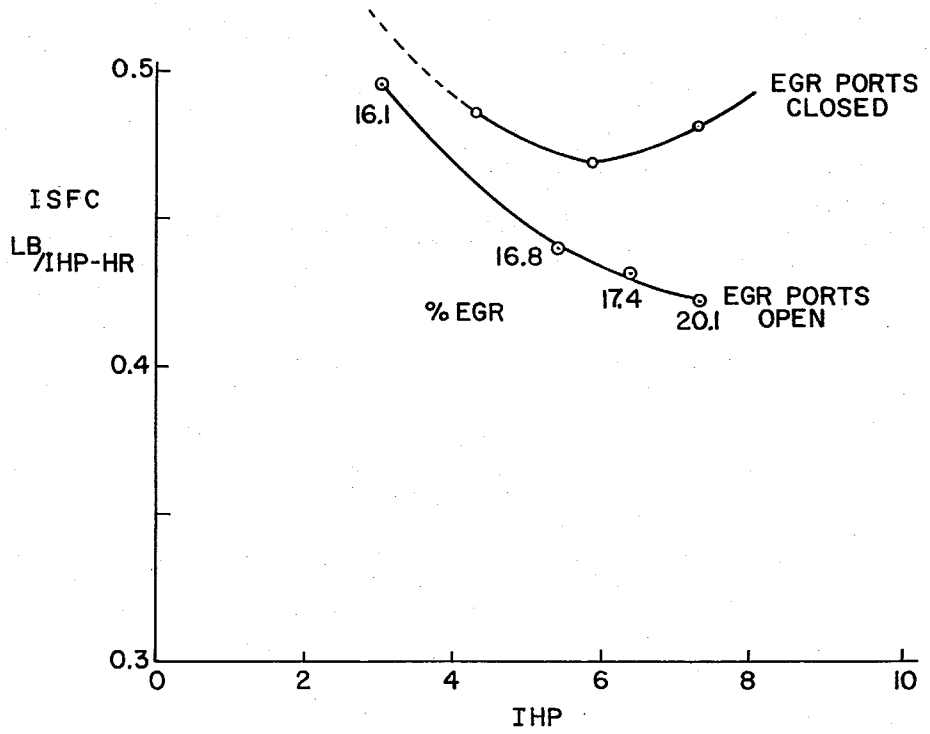
FIG. 10 is a diagram showing the effect of stratified exhaust gas recirculation on the specific fuel consumption of a modified Volkswagen engine with the EGR ports open and closed and with the engine operating at 1,800 RPM in each case.

Referring now to FIG. 10, there is shown the Indicated Specific Fuel Consumption (ISFC) versus Indicated Horse Power (IHP) for the modified engine with the EGR ports open and the EGR ports closed, operating in each case at 1,800 RPM. During the test runs the fuel/air mixture was at stoichiometric ratio. The test results display an average 10% reduction in the indicated specific fuel consumption with the EGR ports open.

Evidence that the problem of slow combustion when operating with high EGR rate is overcome by the Stratified EGR design is shown by the test results in the following table:

| | % EGR | IHP | Peak Cylinder Pressure PSI | Peak Pressure Rate, dP/dt PSI per S |
|---|---|---|---|---|
| Stock engine | 0 | 7.7 | 770 | $3 \times 10^5$ |
| Stratified EGR | 50% | 7.7 | 770 | $2.2 \times 10^5$ |

The comparison shows that peak cylinder pressure was the same and that peak pressure rate, which is a measure of the maximum rate of combustion, was close.

In the foregoing examples and discussion the Improved Stratified Exhaust Gas Recirculating Engine was of the type wherein the exhaust gas tangential ports in the cylinders were connected via conduit means such that cylinders 1 and 3 and 4 and 2 are connected in a four cylinder, four stroke engine. It is, however, contemplated that the exhaust gas inlet ports to each of the cylinders could be connected to the exhaust manifold as the exhaust gas manifold pressure would be peaking from one of the cylinders at the same time that a demand for exhaust gas existed for another cylinder.

I claim:

1. In a multi-cylinder internal combustion engine having a fuel and an air source connected to each cylinder via a substantially centrally located intake valve means in each cylinder; means for stratifying a combustible fuel/air mixture and exhaust gas in the cylinder during the intake stroke, said means for stratifying comprising:

(a) fuel/air mixture swirling means for each cylinder;
(b) at least one inlet port in each cylinder open to each cylinder from about 60° BBDC to about 60° ABDC;
(c) conduit means connecting each said at least one inlet port with a source of pressurized exhaust gas;
(d) said source of pressurized exhaust gas comprising the gas exhausting from the cylinder 360° apart on the firing order of the engine;
(e) means for causing the exhaust gas to swirl in each cylinder in the same direction as the swirl of the air/fuel mixture.

2. The internal combustion engine as defined in claim 1 wherein the exhaust gas swirls about the inner surface of the cylinder and the fuel/air mixture swirls in a central zone in the cylinder.

3. The internal combustion engine as defined in claim 2 further including tangential inlet means forming the at least one exhaust gas inlet port for each cylinder.

4. The internal combustion engine as defined in claim 3 further including a variable throttle valve means in each of the conduits connecting the at least one exhaust gas inlet port with the source of pressurized exhaust gas.

5. In a multi-cylinder internal combustion engine having a carburetor connected to each cylinder via a substantially centered intake valve means in each cylinder during the intake stroke said means for stratifying comprising:

(a) fuel/air mixture swirling means upstream of the intake valve of each cylinder;
(b) at least one tangential inlet port in each cylinder open to each cylinder from about 60° BBDC to about 60° ABDC; and
(c) conduit means connecting each tangential inlet port with pressurized exhaust gas exhausting from the cylinder 360° apart on the firing order of the engine.

6. A method of operating at least a two cylinder internal combustion engine comprising the steps:

(a) directing in a swirling path air or a combustible fuel/air mixture into an engine cylinder during the intake stroke;
(b) tangentially admitting in a swirling path exhaust gas exhausting from a cylinder 360° apart on the firing order of the engine, into the cylinder to provide a stratified charge of air or a fuel/air mixture and exhaust gas;
(c) compressing the stratified charge;
(d) igniting the stratified charge;
(e) expanding the charge to produce useful work; and
(f) exhausting the cylinder.

* * * * *